US011498106B2

(12) United States Patent
Williams et al.

(10) Patent No.: US 11,498,106 B2
(45) Date of Patent: Nov. 15, 2022

(54) CONDUIT BENDER

(71) Applicant: MILWAUKEE ELECTRIC TOOL CORPORATION, Brookfield, WI (US)

(72) Inventors: Aaron M. Williams, Milwaukee, WI (US); Kyle Reeder, Waukesha, WI (US); Christopher S. Hoppe, Milwaukee, WI (US); Jacob Feuerstein, San Diego, CA (US); George Barton, Mequon, WI (US); Matthew W. Naiva, Wauwatosa, WI (US); Matthew A. Lownik, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 326 days.

(21) Appl. No.: 15/934,195

(22) Filed: Mar. 23, 2018

(65) Prior Publication Data

US 2018/0272404 A1 Sep. 27, 2018

Related U.S. Application Data

(60) Provisional application No. 62/631,245, filed on Feb. 15, 2018, provisional application No. 62/507,312, (Continued)

(51) Int. Cl.
*B21D 7/022* (2006.01)
*B21D 7/06* (2006.01)

(52) U.S. Cl.
CPC ..... *B21D 7/063* (2013.01); *B21D 7/022* (2013.01)

(58) Field of Classification Search
CPC . B21D 7/022; B21D 7/04; B21D 7/02; B21D 7/06; B21D 7/085; B21D 7/14
(Continued)

(56) References Cited

U.S. PATENT DOCUMENTS 2,630,033 A 3/1953 Stover
2,817,986 A 12/1957 Benfield
(Continued)

FOREIGN PATENT DOCUMENTS

GB 937810 9/1963
GB 1090383 11/1967
(Continued)

OTHER PUBLICATIONS

International Searching Authority, "International Search Report and Written Opinion," issued in connection with International Patent Application No. PCT/US2018/024020, dated Jul. 5, 2018, 14 pages.

*Primary Examiner* — Debra M Sullivan
(74) *Attorney, Agent, or Firm* — Reinhart Boerner Van Deuren s.c.

(57) ABSTRACT

A tool for bending an elongated workpiece includes a shaft having a first shaft portion and a second shaft portion, and a coupling assembly coupling the first shaft portion and the second shaft portion. The coupling assembly has a locked configuration in which the coupling assembly inhibits movement of the first shaft portion relative to the second shaft portion and an unlocked configuration in which the coupling assembly permits movement of the first shaft portion relative to the second shaft portion. The tool also includes a shoe coupled to the second shaft portion. The shoe has a curved bottom portion and a hook configured to hold the workpiece against the curved bottom portion. The curved bottom portion is engageable with the workpiece to bend the workpiece.

22 Claims, 16 Drawing Sheets

Related U.S. Application Data filed on May 17, 2017, provisional application No. 62/502,078, filed on May 5, 2017, provisional application No. 62/476,273, filed on Mar. 24, 2017.

(58) Field of Classification Search
USPC ..... 72/149, 369, 481.3, 481.8
See application file for complete search history.

(56) References Cited

U.S. PATENT DOCUMENTS

| | | | | | |
|---|---|---|---|---|---|
| 2,906,149 | A * | 9/1959 | Benfield | B21D 7/063 | 72/458 |
| 3,246,498 | A | 4/1966 | Mount | | |
| 3,253,441 | A | 5/1966 | Benfield | | |
| 3,336,779 | A * | 8/1967 | Schall | B21D 7/063 | 72/217 |
| 3,590,617 | A | 7/1971 | Mount | | |
| 3,718,018 | A | 2/1973 | Benfield | | |
| 3,906,778 | A | 9/1975 | Crouse | | |
| 4,009,602 | A | 3/1977 | Linguist | | |
| 4,052,881 | A * | 10/1977 | Mount | B21D 7/063 | 72/459 |
| 4,196,610 | A * | 4/1980 | Chilton | B21D 7/063 | 403/97 |
| 4,269,056 | A * | 5/1981 | Kozinski | B21D 7/063 | 72/459 |
| 4,425,784 | A | 1/1984 | D'Gerolamo | | |
| 4,442,695 | A | 4/1984 | Gardner | | |
| 4,452,064 | A | 6/1984 | Custin | | |
| 4,587,832 | A * | 5/1986 | Illguth | B21D 7/063 | 72/17.3 |
| 4,622,837 | A | 11/1986 | Bergman | | |
| 5,154,000 | A | 10/1992 | Mahoney et al. | | |
| 5,868,515 | A * | 2/1999 | Janssen | B05C 17/00 | 16/225 |
| 5,927,141 | A | 7/1999 | Walsten | | |
| 6,385,856 | B1 | 5/2002 | Godin | | |
| 6,820,457 | B2 | 11/2004 | Luebke et al. | | |
| 7,055,362 | B2 | 6/2006 | Widmayer | | |
| 7,328,601 | B1 | 2/2008 | King | | |
| 2008/0236240 | A1 * | 10/2008 | Bates | B21D 7/022 | 72/388 |
| 2009/0188291 | A1 | 7/2009 | Itrich et al. | | |
| 2011/0289762 | A1 * | 12/2011 | Wille | B25B 27/0014 | 29/525.06 |
| 2013/0029792 | A1 * | 1/2013 | Abdelmalek | A63B 60/00 | 403/361 |
| 2015/0033813 | A1 * | 2/2015 | Leclerc | B21D 7/14 | 72/37 |
| 2017/0095849 | A1 | 4/2017 | Nobles | | |
| 2017/0274437 | A1 * | 9/2017 | Klinger | B21D 7/063 | |

FOREIGN PATENT DOCUMENTS

| | | |
|---|---|---|
| GB | 1384582 | 2/1975 |
| WO | WO0071973 | 11/2000 |
| WO | WO2013131179 | 9/2013 |
| WO | WO2015184432 | 12/2015 |

* cited by examiner

CONDUIT BENDER

CROSS-REFERENCE TO RELATED APPLICATIONS

This application claims priority to U.S. Provisional Patent Application No. 62/476,273 filed on Mar. 24, 2017, U.S. Provisional Patent Application No. 62/502,078 filed on May 5, 2017, U.S. Provisional Patent Application No. 62/507,312 filed on May 17, 2017, and U.S. Provisional Patent Application No. 62/631,245 filed on Feb. 15, 2018, the entire content of each of which is incorporated herein by reference.

FIELD OF THE INVENTION

The present invention relates to conduit benders, and more particularly to manual conduit benders.

BACKGROUND

Conduits are often used to conceal and protect electrical wiring. Often the conduits must be bent to the contour of an adjacent surface, such as a wall or ceiling. Conduit may also be bent to orient the conduit in a desired direction. Tools for elongated workpieces like conduit ("conduit benders") are often used to bend conduit to a desired angle without collapsing the wall of the conduit. Conduit benders typically include a long handle or shaft to provide sufficient leverage to bend the conduit. However, it may be difficult to manipulate the handle in confined spaces. In addition, the user may need to crouch or bend down to move the handle a sufficient distance toward the ground to form the desired angle in the conduit.

SUMMARY

The invention provides, in one aspect, a tool for bending an elongated workpiece. The tool includes a shaft having a first shaft portion and a second shaft portion, and a coupling assembly coupling the first shaft portion and the second shaft portion. The coupling assembly has a locked configuration in which the coupling assembly inhibits movement of the first shaft portion relative to the second shaft portion and an unlocked configuration in which the coupling assembly permits movement of the first shaft portion relative to the second shaft portion. The tool also includes a shoe coupled to the second shaft portion. The shoe has a curved bottom portion and a hook configured to hold the workpiece against the curved bottom portion. The curved bottom portion is engageable with the workpiece to bend the workpiece.

The invention provides, in another aspect, a tool for bending an elongated workpiece. The tool has a shaft with a first shaft portion defining a first longitudinal axis and a second shaft portion defining a second longitudinal axis. A coupling assembly couples the first shaft portion and the second shaft portion. The coupling assembly is operable to selectively permit the first shaft portion to pivot relative to the second shaft portion about a pivot axis oriented transverse to the first longitudinal axis and the second longitudinal axis. The conduit bender also includes a shoe coupled to the second shaft portion, the shoe including a curved bottom portion and a hook configured to hold the workpiece against the curved bottom portion. The curved bottom portion is engageable with the workpiece to bend the workpiece.

The invention provides, in another aspect, a method of bending an elongated workpiece. The method includes positioning the workpiece against a curved bottom portion of a shoe, bending the workpiece with the shoe by applying force to a shaft extending from the shoe, reorienting a first portion of the shaft relative to a second portion of the shaft, the second portion of the shaft being coupled to the shoe, and after reorienting, further bending the workpiece with the shoe by applying force to the shaft.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
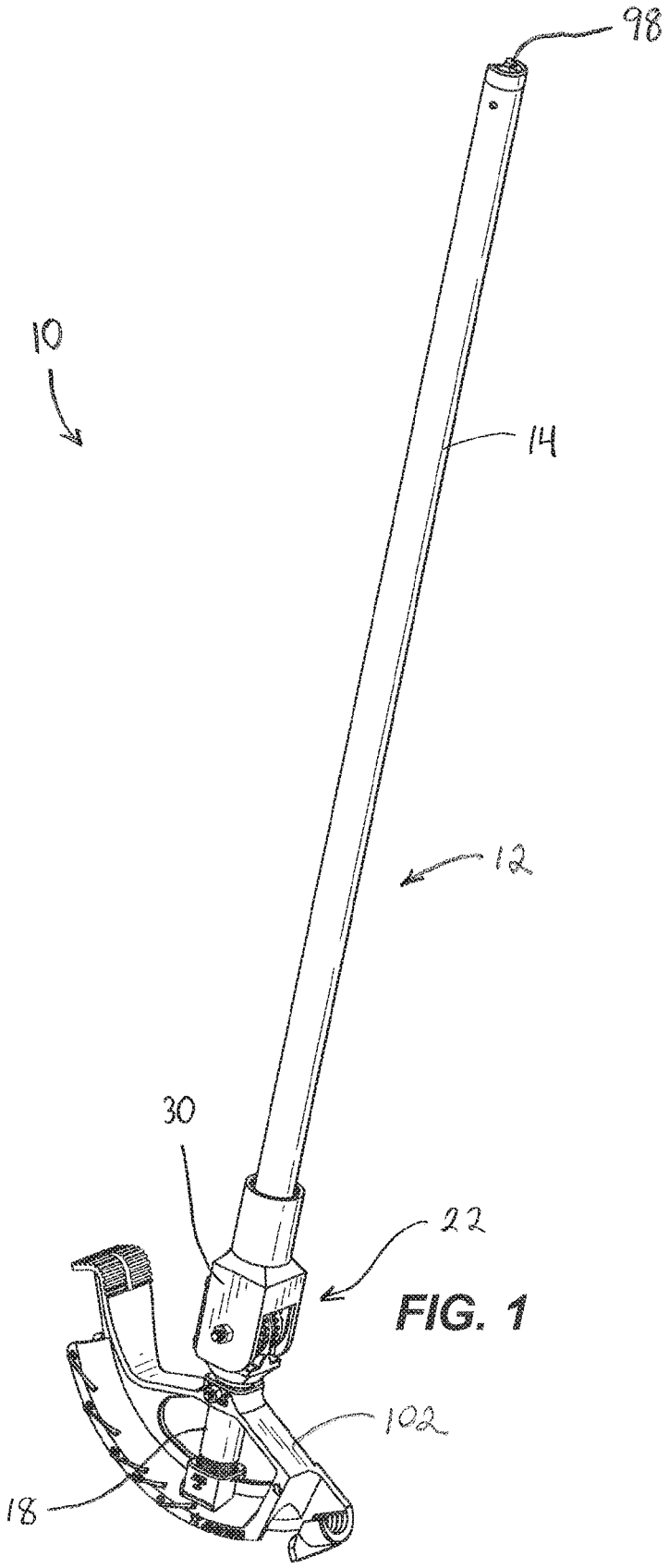
FIG. 1 is a perspective view of a conduit bender in accordance with an embodiment of the invention.

FIG. 1 illustrates a conduit bender 10 that can be used to bend an elongated workpiece (e.g., a conduit, pipe, etc.; not shown) of a variety of different materials (e.g., brass, copper, aluminum, steel, PVC, etc.). The conduit bender 10 includes a handle or shaft 12 with a first shaft portion 14, a second shaft portion 18, and a coupling assembly 22 coupling the first shaft portion 14 and the second shaft portion 18 together. An end of the second shaft portion 18 opposite the coupling assembly 22 is coupled to a head or shoe 102 of the conduit bender 10. In the illustrated embodiment, the second shaft portion 18 is coupled to the shoe 102 by a threaded connection 19 (FIG. 2), but the second shaft portion 18 may be coupled to the shoe 102 in other ways.

Figure 9:
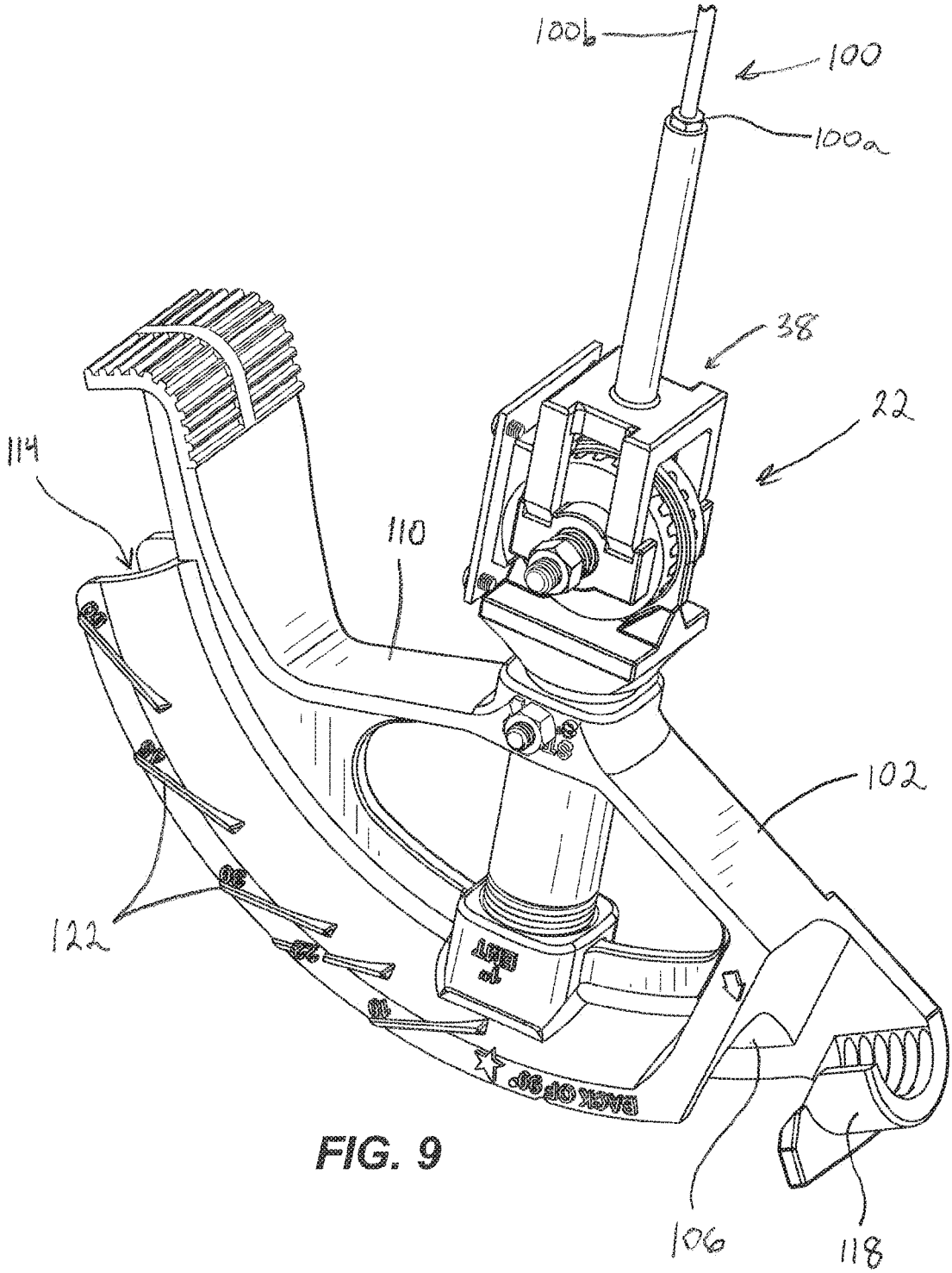
FIG. 9 is a perspective view of a portion of the conduit bender of FIG. 1 with a first shaft portion and a gear housing removed.

Referring to FIG. 9, the shoe 102 includes a curved bottom portion 106 and a top portion 110. A passageway 114 extends the length of the bottom portion 106. The passageway 114 is configured to partially surround the workpiece. The shoe 102 also includes a hook 118 at an end of the passageway 114 that holds the workpiece against the bottom portion 106 in the passageway 114. The shoe 102 is preferably made by casting (e.g., from cast iron) but can be made via other processes and from other materials. The shoe 102 may be powder coated to increase durability and inhibit corrosion.

In the illustrated embodiment, the shoe 102 further includes a plurality of markings 122 that form a scale. The markings 122 may indicate, for example, bend angles ranging from 10 degrees to 60 degrees and facilitate using the conduit bender 10 to bend the elongated workpiece to a desired angle. The markings 122 are colored so as to provide high visibility or high contrast with the remainder of the shoe 102. For example, the markings 122 may be a color that is different and/or lighter than the rest of the shoe 102, providing clear visibility in a variety of lighting conditions. The markings 122 are preferably embossed (raised) and integrally formed with the shoe 102. In such embodiments, the entire shoe 102 may be powder coated with a first color (e.g., white), then subsequently powder coated with a second color (e.g., black). The second color may then be wiped off the raised markings 122 before drying or curing such that the markings 122 remain the first color.

Figure 2:
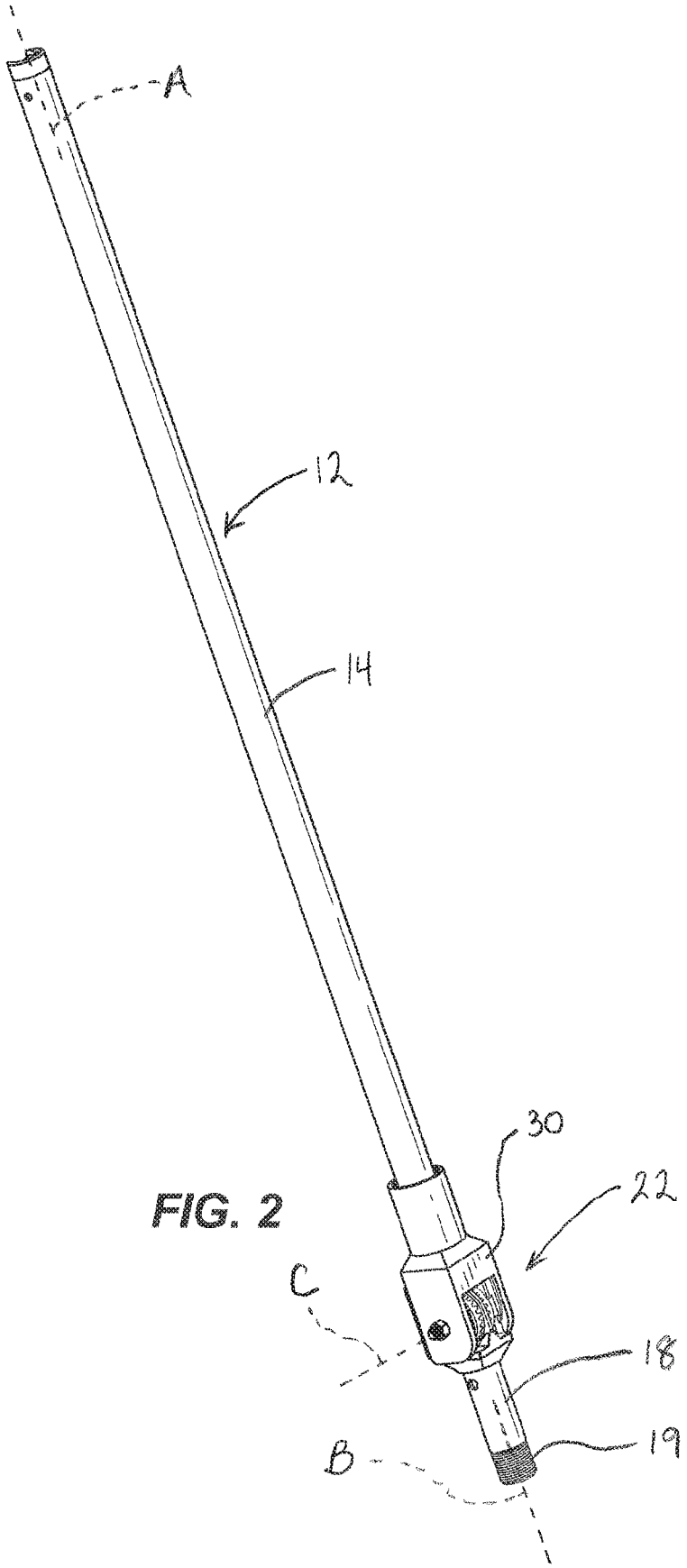
FIG. 2 is a perspective view of a portion of the conduit bender of FIG. 1.

The first shaft portion 14 forms the majority of the length of the shaft 12 and may be used to provide leverage to bend the workpiece by pivoting the shoe 102 (FIG. 1). The first shaft portion 14 defines a longitudinal axis A, and the second shaft portion 18 defines a longitudinal axis B (FIG. 2). The coupling assembly 22 allows the first shaft portion 14 to be adjustably pivoted about a pivot axis C relative to the second shaft portion 18, and thus the shoe 102, as described in more detail below. The pivot axis C extends transverse to both the longitudinal axes A, B of the first and second shaft portions 14, 18.

Figure 3:
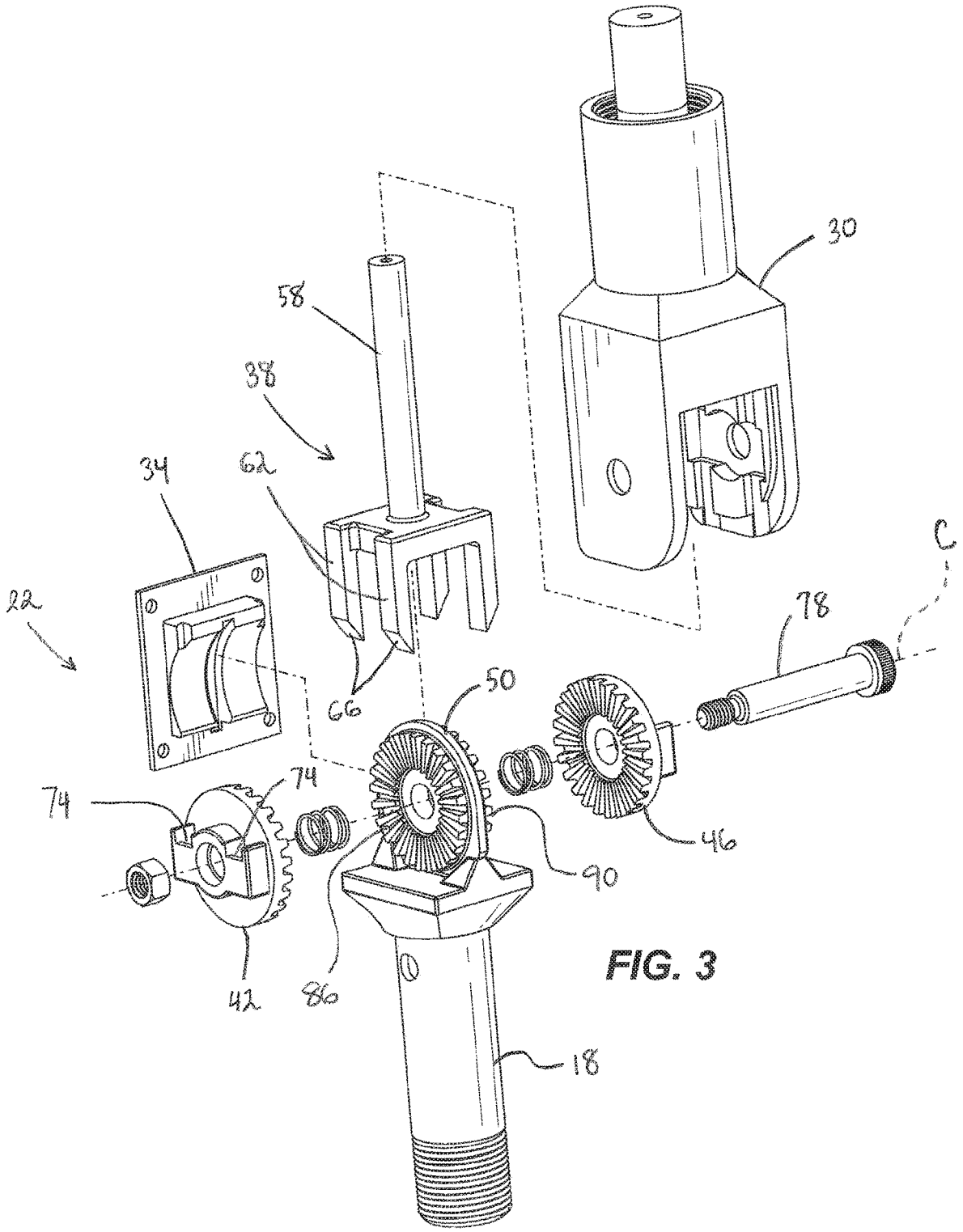
FIG. 3 is an exploded view of a coupling assembly of the conduit bender of FIG. 1.

Referring to FIG. 3, the illustrated coupling assembly 22 includes a gear housing 30, a rear housing plate 34, a wedge member 38, first and second outer face gears 42, 46, (or first toothed members) and an inner face gear 50 (or second toothed member). The outer face gears 42, 46 and the inner face gear 50 can be "Hirth" gears, for example. The gear housing 30 is fixedly coupled to an end of the first shaft portion 14 (FIG. 2). The wedge member 38 includes a wedge shaft 58, and two pairs of arms 62, each arm having a cam surface 66 on a distal end thereof (FIG. 3). The wedge shaft 58 extends out of the housing 30 and into a hollow interior of the first shaft portion 14, and is slidably movable along the longitudinal axis A of the first shaft portion 14 within the housing 30.

Each of the first and second outer face gears 42, 46 has a side with teeth, and an opposite side with two cam recesses 74. Each cam recess 74 is arranged to slidingly receive one of the arms 62 of the wedge member 38. Each outer face gear 42, 46 is supported within the housing 30 so as to be movable along the pivot axis C. The inner face gear 50 is coupled to an end of the second shaft portion 18 opposite the shoe 102. In the illustrated embodiment, the inner face gear 50 is integrally formed with the second shaft portion 18. The inner face gear 50 has first and second opposite faces 86, 90 with teeth that engage with the corresponding teeth of the first and second outer face gears 42, 46, respectively. The inner face gear 50 is rotatably supported on a pin 78 to pivotally couple the second shaft portion 18 to the first shaft portion 14 about the pivot axis C.

Figure 4:
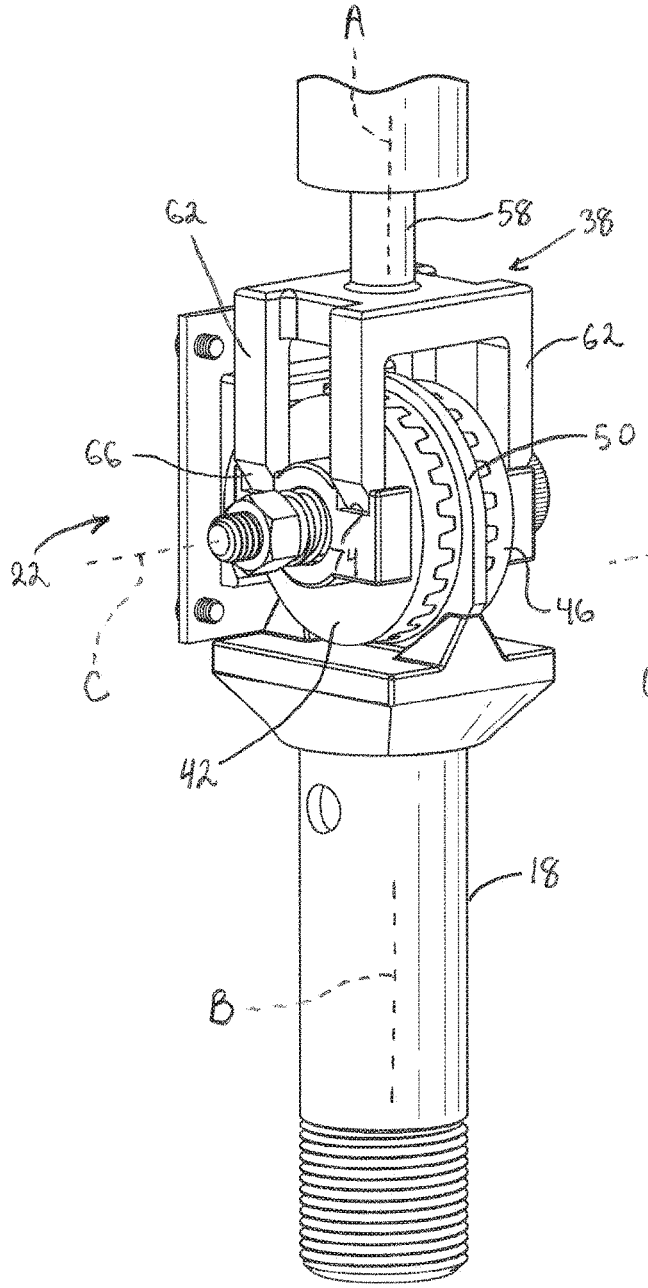
FIG. 4 is a perspective view of the coupling assembly of FIG. 3 in a locked configuration while the conduit bender is in a straight configuration.

The first and second outer face gears 42, 46 are movable along the pivot axis C between a locked configuration (FIG. 4) and an unlocked configuration (FIG. 5) of the coupling assembly 22. In the locked configuration, the teeth of the first outer face gear 42 engage the teeth of the first face 86 of the inner face gear 50 while the teeth of the second outer face gear 46 engage the teeth of the second face of the inner face gear 50 to secure the first shaft portion 14 and the second shaft portion 18 from being pivoted relative to one another about the pivot axis C. In the unlocked configuration, the first and second outer face gears 42, 46 are spaced from the respective first and second faces 86, 90 of the inner face gear 50 to allow the first shaft portion 14 and the second shaft portion 18 to be adjustably pivoted relative to one another about the pivot axis C.

Figures 6, 7:
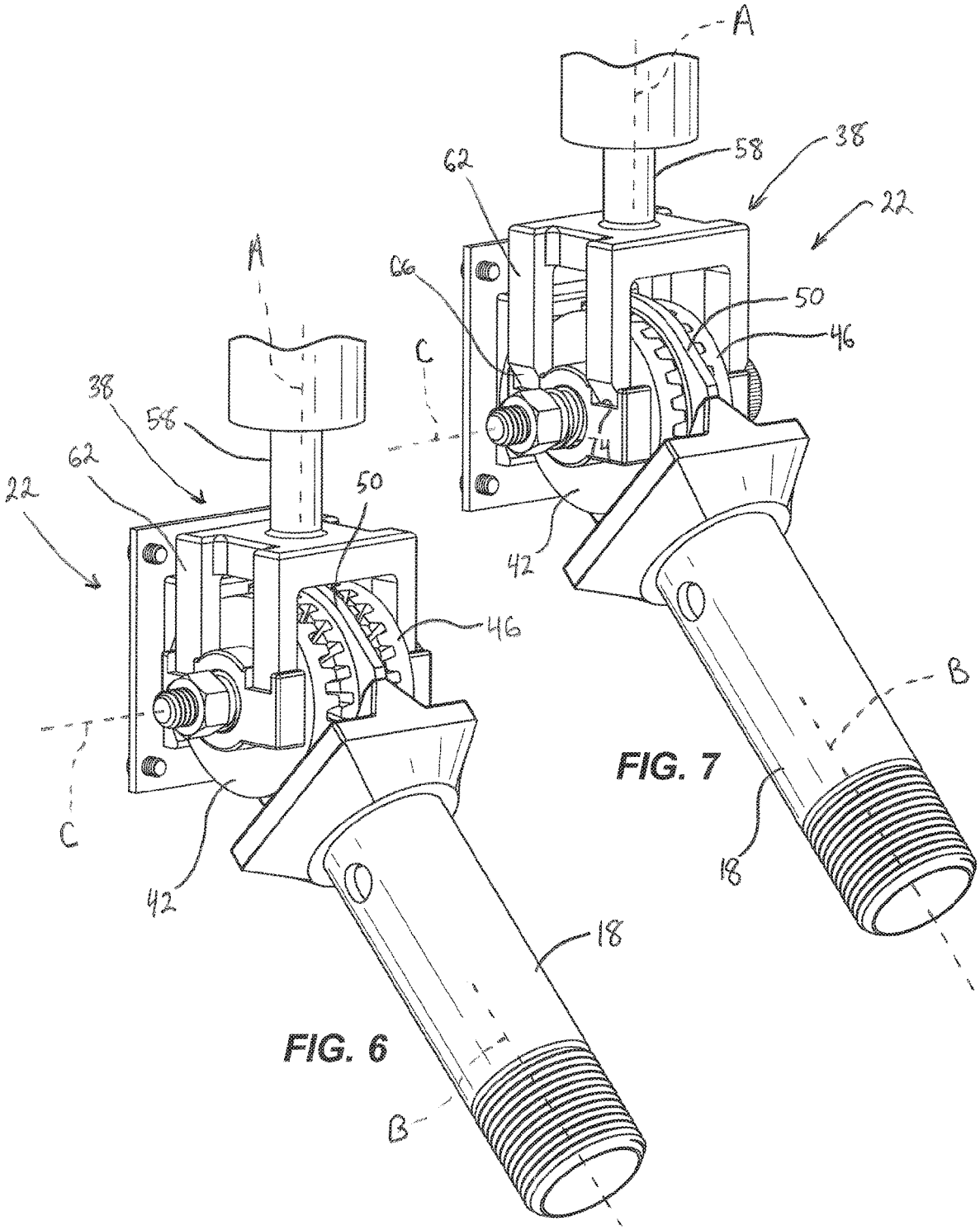
FIG. 6 is a perspective view of the coupling assembly of FIG. 3 in the unlocked configuration while the conduit bender is in a pivoted configuration.
FIG. 7 is a perspective view of the coupling assembly of FIG. 3 in the locked configuration while the conduit bender is in the pivoted configuration.

The longitudinal axes A, B of the first and second shaft portions 14, 18 may be in-line, in a straight configuration (FIGS. 1 and 4-5), or they may form an angle, in a pivoted configuration (FIGS. 6-7). The wedge member 38 is movable along the longitudinal axis A of the first shaft portion 14 to move the outer face gears 42, 46 between the locked and unlocked configurations. In the locked configuration (FIG. 4), the wedge member 38 is raised relative to the outer face gears 42, 46 such that the cam surfaces 66 of the arms 62 are not engaged with the corresponding cam surfaces (not shown) within the cam recesses 74 allowing the outer face gears 42, 46 to be engage the inner face gear 50 to inhibit pivoting of (i.e., fix) the first and second shaft portions 14, 18 relative to one another about the pivot axis C. In some embodiments, the outer face gears 42, 46 may be biased into engagement with the inner face gear 50 when in the locked configuration.

In the unlocked configuration (FIG. 5), the wedge member 38 is moved towards the outer face gears 42, 46 such that the cam surfaces of the arms 62 urge the outer face gears 42, 46 away from and out of engagement with the inner face gear 50 to allow adjustable pivoting of the first and second shaft portions 14, 18 relative to one another about the pivot axis C. The wedge member 38 may be moved along the longitudinal axis A via an actuator 98 (FIGS. 1 and 8) provided at an end of the first shaft portion 14 opposite the coupling assembly 22. In the illustrated embodiment, the actuator 98 includes a push button. The actuator 98 is connected to the wedge shaft 58 of the wedge member 38, through the hollow interior of the first shaft portion 14, by a connector 100 (FIG. 9). In one embodiment, the connector 100 includes a threaded shaft 100*a* and a bowden cable 100*b*. In other embodiments other types of connectors can be used that allow the user to move the actuator 98 to lift the wedge member 38. In the illustrated embodiment, when the actuator 98 is depressed, a mechanical linkage lifts the wedge member 38 to separate the face gears 42, 46 allowing the first shaft portion 14 to pivot relative to the second shaft portion 18. When the button 98 is released, the face gears 42, 46 reengage with the inner face gear 50, preventing pivoting between the first shaft portion 14 and the second shaft portion 18, and allowing conduit bending by applying force to the shaft 12.

Figure 5:
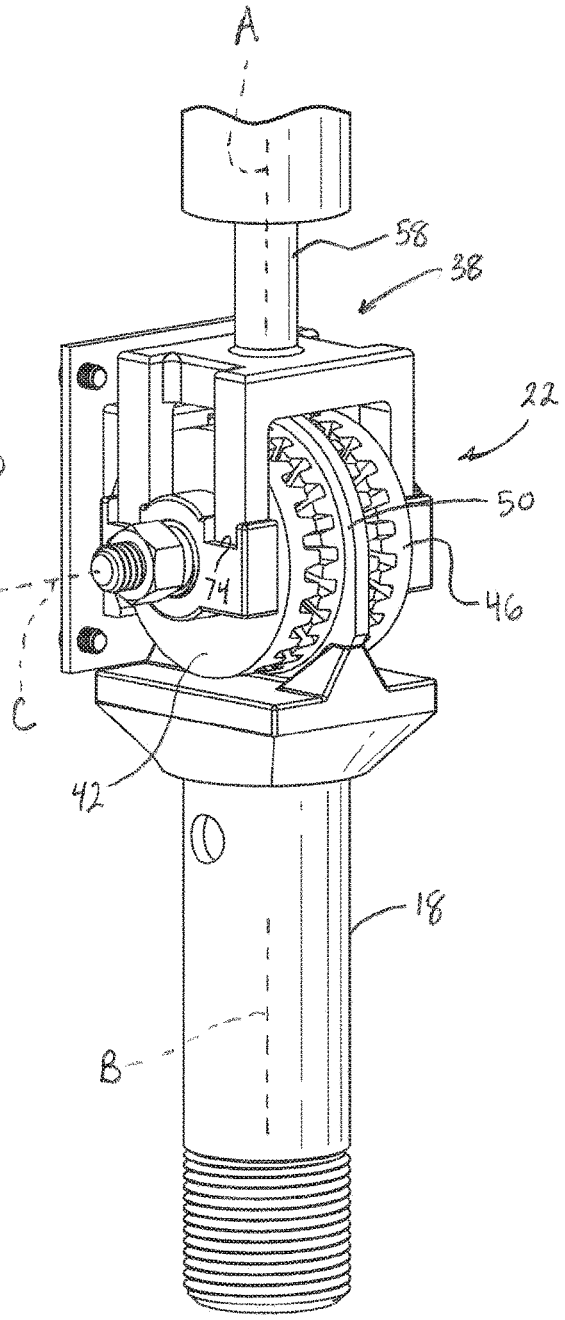
FIG. 5 is a perspective view of the coupling assembly of FIG. 3 in an unlocked configuration while the conduit bender is in the straight configuration.

In operation, while the first shaft portion 14 and the second shaft portion 18 are in the straight configuration (FIG. 1) and the coupling assembly 22 is in the locked configuration (FIG. 4), a user may use the first shaft portion 14 to provide leverage for bending the elongated workpiece. Once the first shaft portion 14 has been pivoted by a certain degree, it may become more difficult to achieve the necessary leverage to apply force and bend the workpiece further. The user may then move the wedge member 38 via the actuator 98 (e.g., by pushing the actuator 98) to engage and move the outer face gears 42, 46 away from the inner face gear 50 along the pivot axis C. This causes the teeth of the outer face gears 42, 46 to disengage from the inner face gear 50, thereby placing the coupling assembly 22 in the unlocked configuration (FIG. 5).

The user may then pivot the first shaft portion 14 relative to the second shaft portion 18 about the pivot axis C by a desired amount or angle into the pivoted configuration (FIG. 6) to provide improved leverage. The user may then move the wedge member 38 via the actuator 98 to disengage from the outer face gears 42, 46 allowing the outer face gears 42, 46 to be moved (e.g., via a biasing force, such as springs) toward the inner face gear 50 such that corresponding teeth engage to secure the first shaft portion 14 and the second shaft portion 18 in the pivoted configuration with the coupling assembly 22 in the locked configuration (FIG. 7). The user may then proceed with further bending the workpiece. This process may be repeated as necessary until the bend is completed. In order to move the first shaft portion 14 and the second shaft portion 18 back to the straight configuration (FIG. 1), the user simply performs the previously described steps in reverse.

Figure 10:
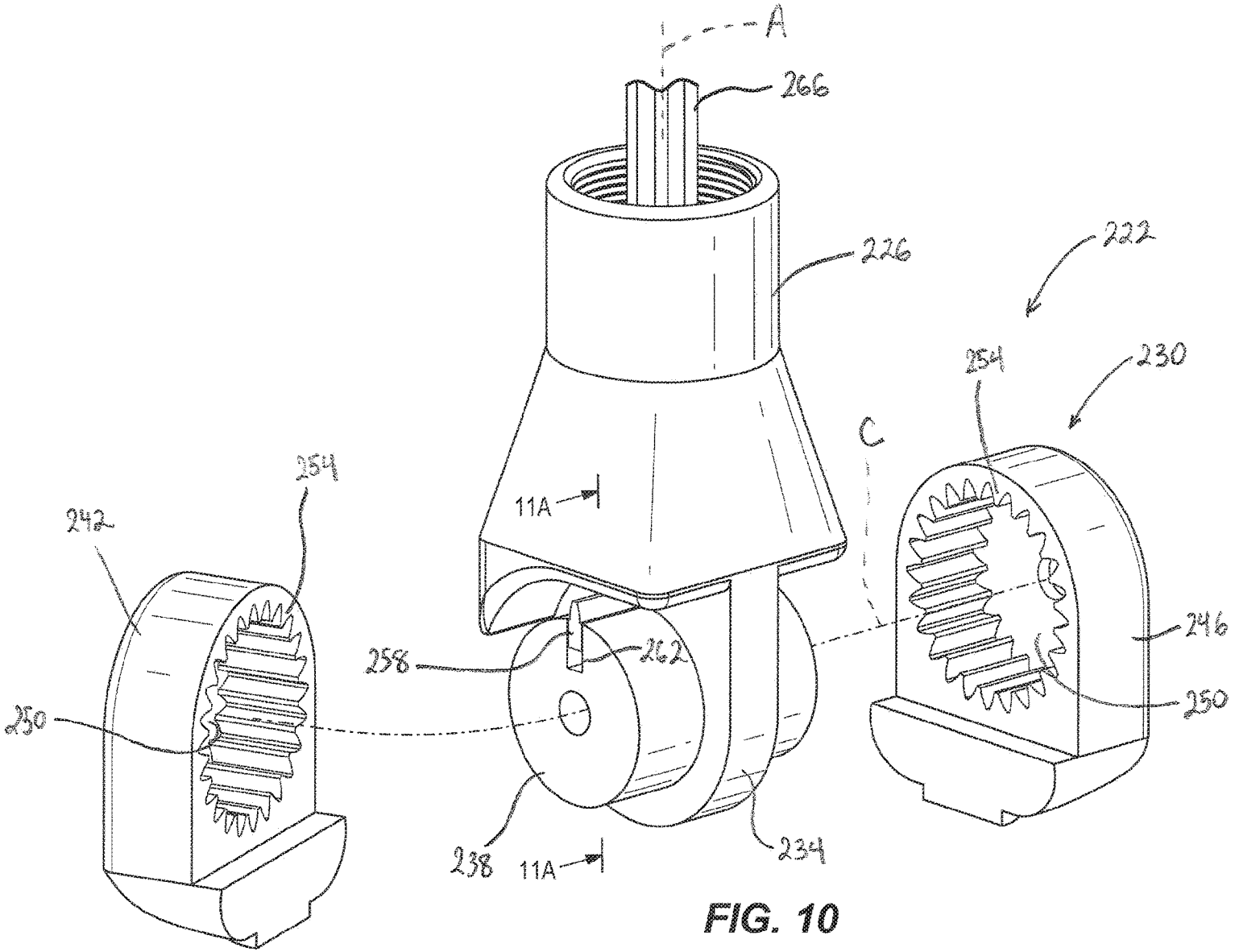
FIG. 10 is an exploded view of a coupling assembly according to another embodiment, usable with the conduit bender of FIG. 1.
Figures 11A, 11B, 11C:
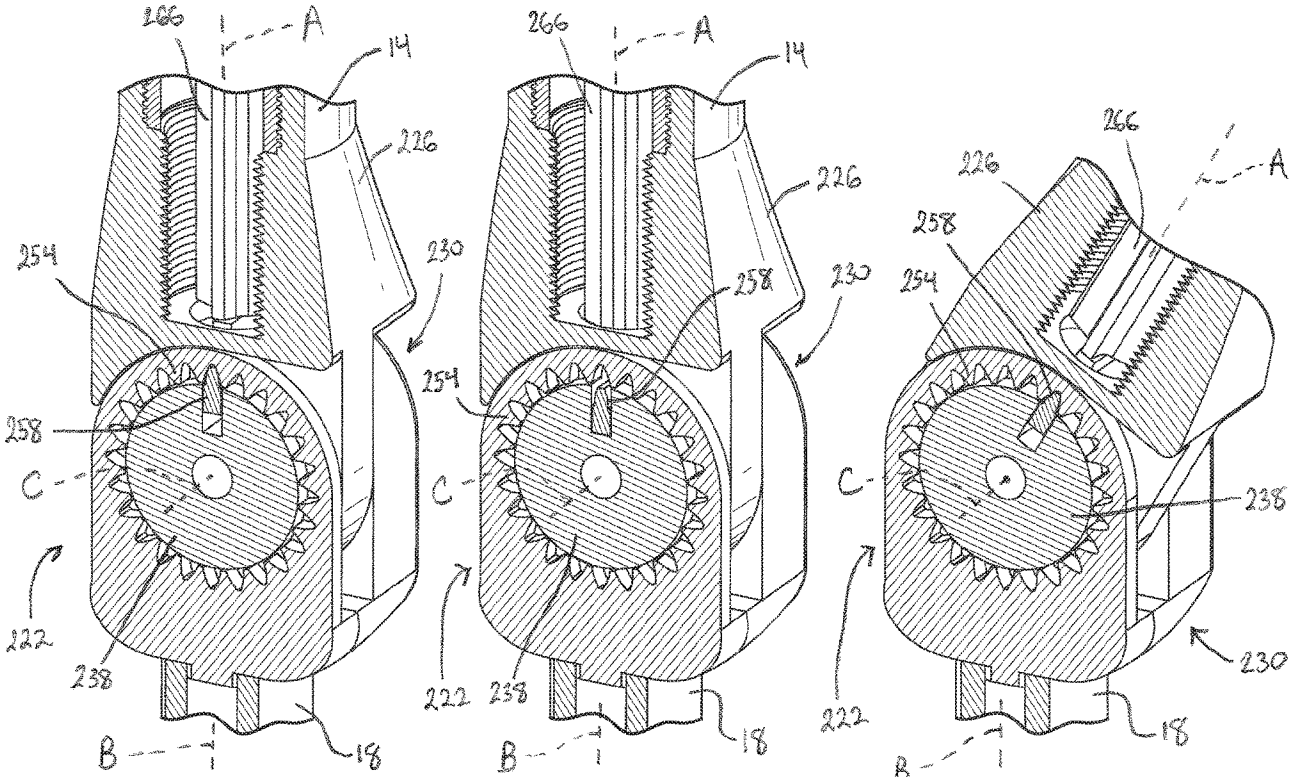
FIG. 11A is a cross-sectional view of the coupling assembly of FIG. 10, taken along line 11A-11A in FIG. 10, with the coupling assembly in a locked configuration while the conduit bender is in the straight configuration.
FIG. 11B is a cross-sectional view of the coupling assembly of FIG. 10, taken along line 11A-11A in FIG. 10, with the coupling assembly in an unlocked configuration while the conduit bender is in the straight configuration.
FIG. 11C is a cross-sectional view of the coupling assembly of FIG. 10, taken along line 11A-11A in FIG. 10, with the coupling assembly in the locked configuration while the conduit bender is in the pivoted configuration.

In some embodiments, the first shaft portion 14 is coupled to the second shaft portion 18, and thus the shoe 102, by a ratchet mechanism in place of the coupling assembly 22 described above with reference to FIGS. 1-7. In such embodiments, when the user moves the first shaft portion 14 about the pivot axis C in a first direction, the first shaft portion 14 is allowed to ratchet freely relative to the shoe 102. When the user tries to move the first shaft portion 14 in a second direction, opposite the first direction, about the pivot axis C, the ratchet mechanism locks and inhibits the first shaft portion 14 from being moved relative to the second shaft portion 18 and the shoe 102, such that the user bends the workpiece via the shoe 102 when moving the first shaft portion 14 in the second direction FIGS. 10-11C illustrate a coupling assembly 222 according to another embodiment and usable with the conduit bender 10 (e.g., in place of the coupling assembly 22 described above with reference to FIGS. 1-7). The coupling assembly 222 includes an attachment portion 226 fixed to the first shaft portion 14 (e.g., via a threaded connection) and an outer housing 230 fixed to the second shaft portion (and thus the shoe 102). The attachment portion 226 includes a center plate 234 and a shaft 238 extending from opposite sides of the center plate 234 along the pivot axis C (FIG. 10).

Figure 8:
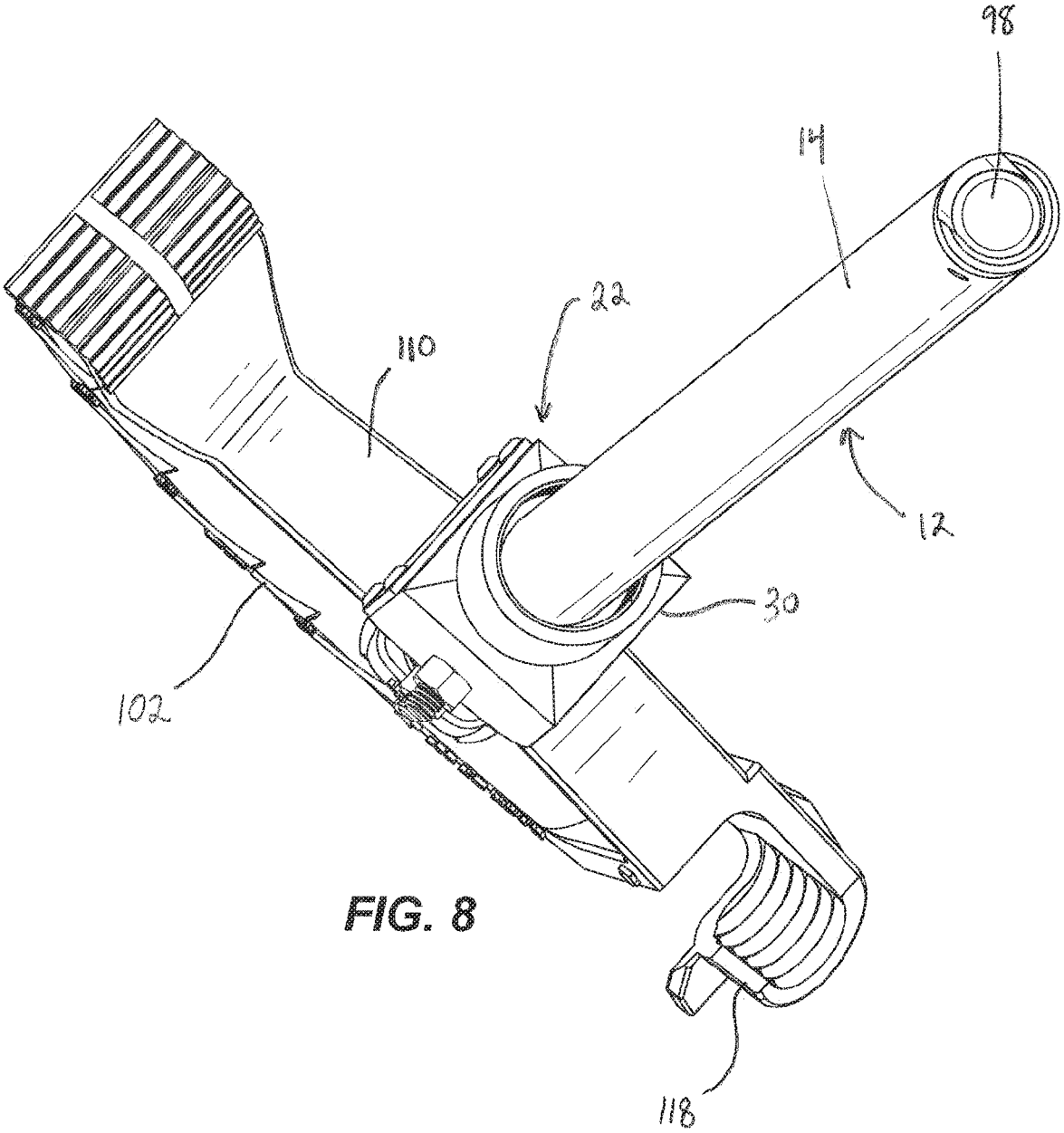
FIG. 8 is a perspective view of the conduit bender of FIG. 1.

With continued reference to FIG. 10, the outer housing 230 includes a first housing element 242 and a second housing element 246. Each of the housing elements 242, 246 includes a recess 250 formed with internal gear teeth 254. The recess 250 of the first housing element 242 receives the shaft 238 on one side of the center plate 234, and the recess 250 of the second housing element 246 receives the shaft 238 on the opposite side of the center plate 234. A pin (not shown) extends through the shaft 238 and the housing elements 242, 246 to pivotally couple the attachment portion 226 and the outer housing 230. The illustrated coupling assembly 222 further includes a tooth 258 slidably received within a radially-extending slot 262 in the shaft 238, and an actuating shaft 266 coupled to the tooth 258. The actuating shaft 266 extends out of the attachment portion 226 and into the hollow interior of the first shaft portion 14, and is slidably movable along the longitudinal axis A of the first shaft portion 14 (e.g., in response to user manipulation of the actuator 98; FIG. 8). The actuating shaft 266 may be directly connected to the actuator 98, or may be coupled to the actuator 98 via a connector.

In operation, the tooth 258 is movable with the actuating shaft 266 along the longitudinal axis A between a locked configuration (FIGS. 11A and 11C) and an unlocked configuration (FIG. 11B) of the coupling assembly 226. In the locked configuration, the tooth 258 (or first toothed member) engages the internal gear teeth 254 of the outer housing 230 (or second toothed member) to secure the first shaft portion 14 and the second shaft portion 18 from being pivoted relative to one another about the pivot axis C. In the unlocked configuration, the tooth 258 is moved radially inward into the shaft 238, disengaging the tooth 258 from the inner gear teeth 254 of the outer housing 230. This allows the attachment portion 226 and the first shaft portion 14 to be adjustably pivoted relative to the outer housing 230 and the second shaft portion 18. The user actuates the coupling assembly 222 from the locked configuration to the unlocked configuration be depressing the actuator 98, which is connected to the actuating shaft 266. The coupling assembly 222 is preferably biased toward the locked configuration (e.g., by a spring acting on the actuator 98, the actuating shaft 266, or the tooth 258).

Figure 12:
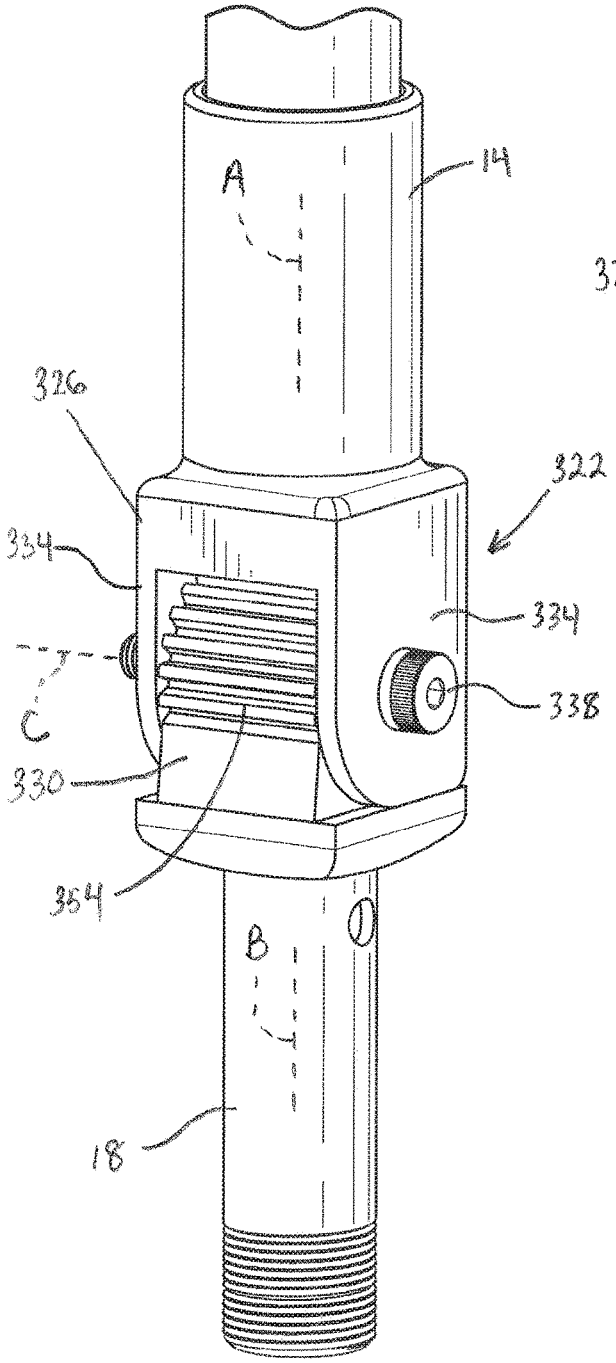
FIG. 12 is a perspective view of a coupling assembly according to another embodiment, usable with the conduit bender of FIG. 1.
Figure 13:
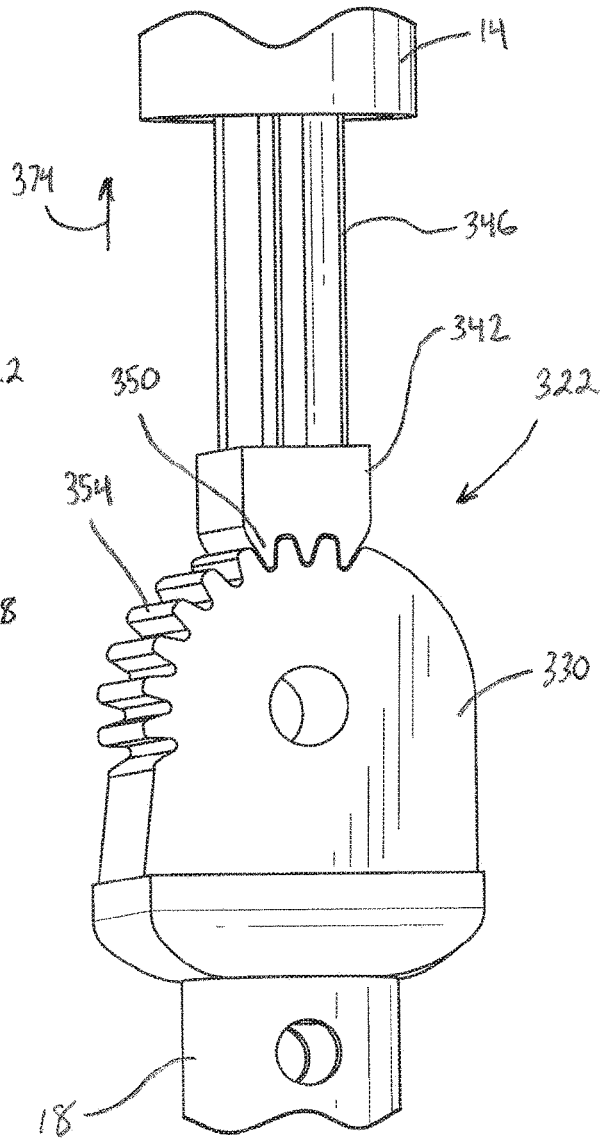
FIG. 13 is a perspective view of the coupling assembly of FIG. 12 in a locked configuration while the conduit bender is in the straight configuration.

FIGS. 12 and 13 illustrate a coupling assembly 322 according to another embodiment and usable with the conduit bender 10. The coupling assembly includes a clevis 326 fixed to the first shaft portion 14 and a gear member 330 fixed to the second shaft portion 18 (and thus the shoe 102). One of or both the clevis 326 and the gear member 330 may be integrally formed with the first shaft portion 14 and the second shaft portion 18, respectively. However, in other embodiments, one of or both the clevis 326 and the gear member 330 may be separate components fixed to the respective first and second shaft portions 14, 18 in a variety of ways.

The gear member 330 is positioned between side plates 334 of the clevis 326. A pin 338 extends through the side plates 334 and the gear member 330 to pivotally couple the clevis 326 to the gear member 330 along the pivot axis C. The illustrated coupling assembly 322 further includes a locking member 342 and an actuating shaft 346 coupled to the locking member 342 (FIG. 13). The locking member 342 includes gear teeth 350 that are selectively engageable with gear teeth 354 on the periphery of the gear member 330. The actuating shaft 346 extends into the hollow interior of the first shaft portion 14 and is slidably movable along the longitudinal axis A of the first shaft portion 14 (e.g., in response to user manipulation of the actuator 98; FIG. 8).

Figure 14:
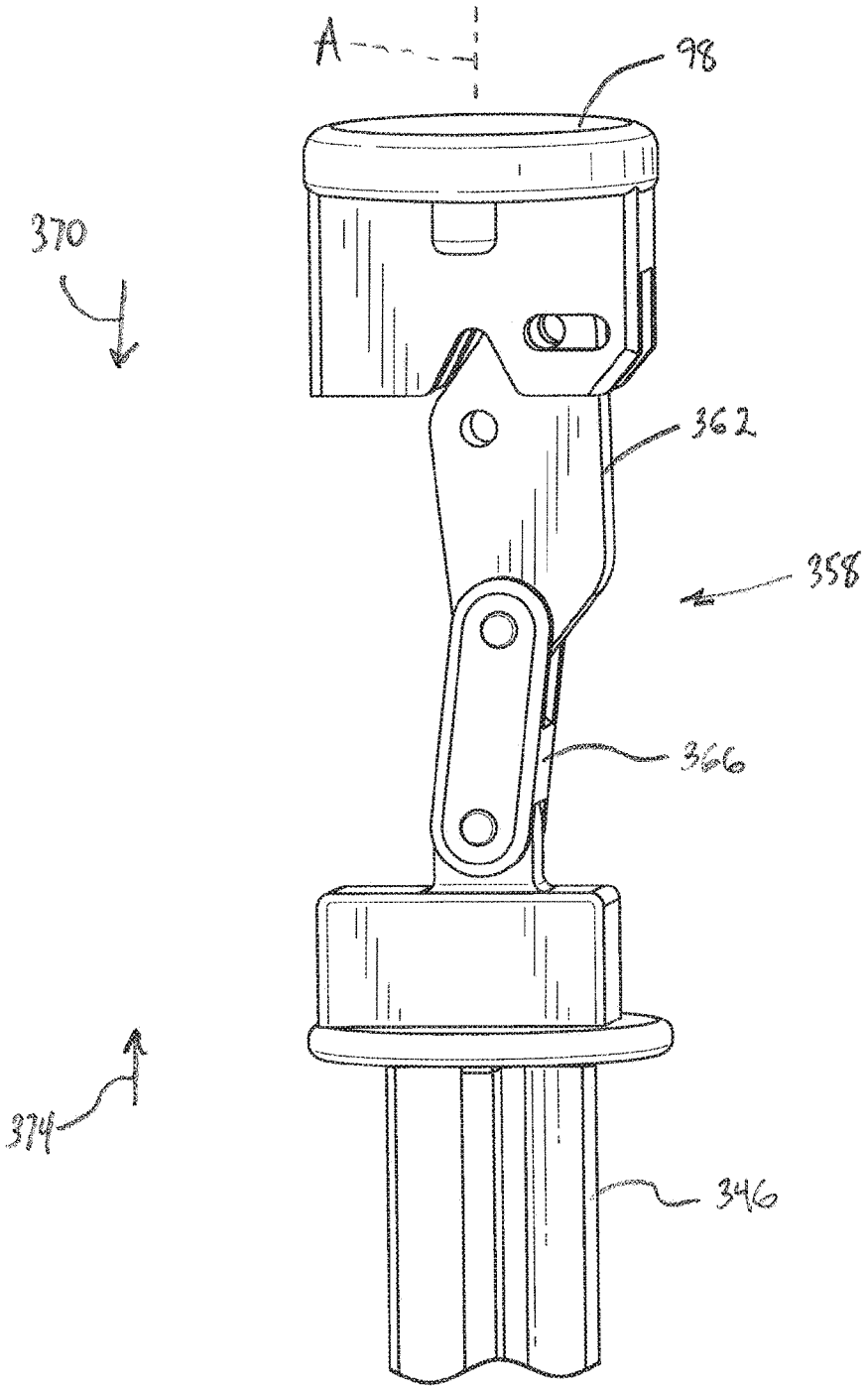
FIG. 14 is a perspective view of an actuator of the coupling assembly of FIG. 12.

With reference to FIG. 14, the actuating shaft 346 is connected to the actuator 98 by a linkage 358. The linkage 358 includes a first link 362 pivotally coupled to the actuator 98 and a second link 366 pivotally coupled to both the shaft 346 and the first link 362. The illustrated linkage 358 is configured as an over-center linkage, and the linkage 358 converts movement of the actuator 98 in a first direction 370 into movement of the actuating shaft 346 in a second direction 374 that is opposite the first direction 370. In the illustrated embodiment, the actuator 98 and the actuating shaft 346 both move axially along the longitudinal axis A.

In operation, the locking member 342 is movable with the actuating shaft 346 along the longitudinal axis A between a locked configuration (FIG. 13) and an unlocked configuration (not shown) of the coupling assembly 322. In the locked configuration, the gear teeth 350 of the locking member 342 (or first toothed member) engage the gear teeth 354 on the gear member 330 (or second toothed member) to secure the first shaft portion 14 and the second shaft portion 18 from being pivoted relative to one another about the pivot axis C. In the unlocked configuration, the actuating shaft 346 and locking member 342 are moved in the direction of arrow 374, disengaging the gear teeth 350 of the locking member 342 from the gear teeth 354 of the gear member 330. This allows the first shaft portion 14 to be adjustably pivoted relative to the gear member 330 and the second shaft portion 18. The user actuates the coupling assembly 322 from the locked configuration to the unlocked configuration be depressing the actuator 98 inward from an initial position to an actuated position. The coupling assembly 322 may be biased toward the locked configuration (e.g., by a spring acting on the actuator 98, the shaft 346, or the linkage 358; FIG. 14). In addition, in the illustrated embodiment, the over-center configuration of the linkage 358 inhibits the locking member 342 from disengaging from the gear member 330 until the actuator 98 is depressed.

Figure 15:
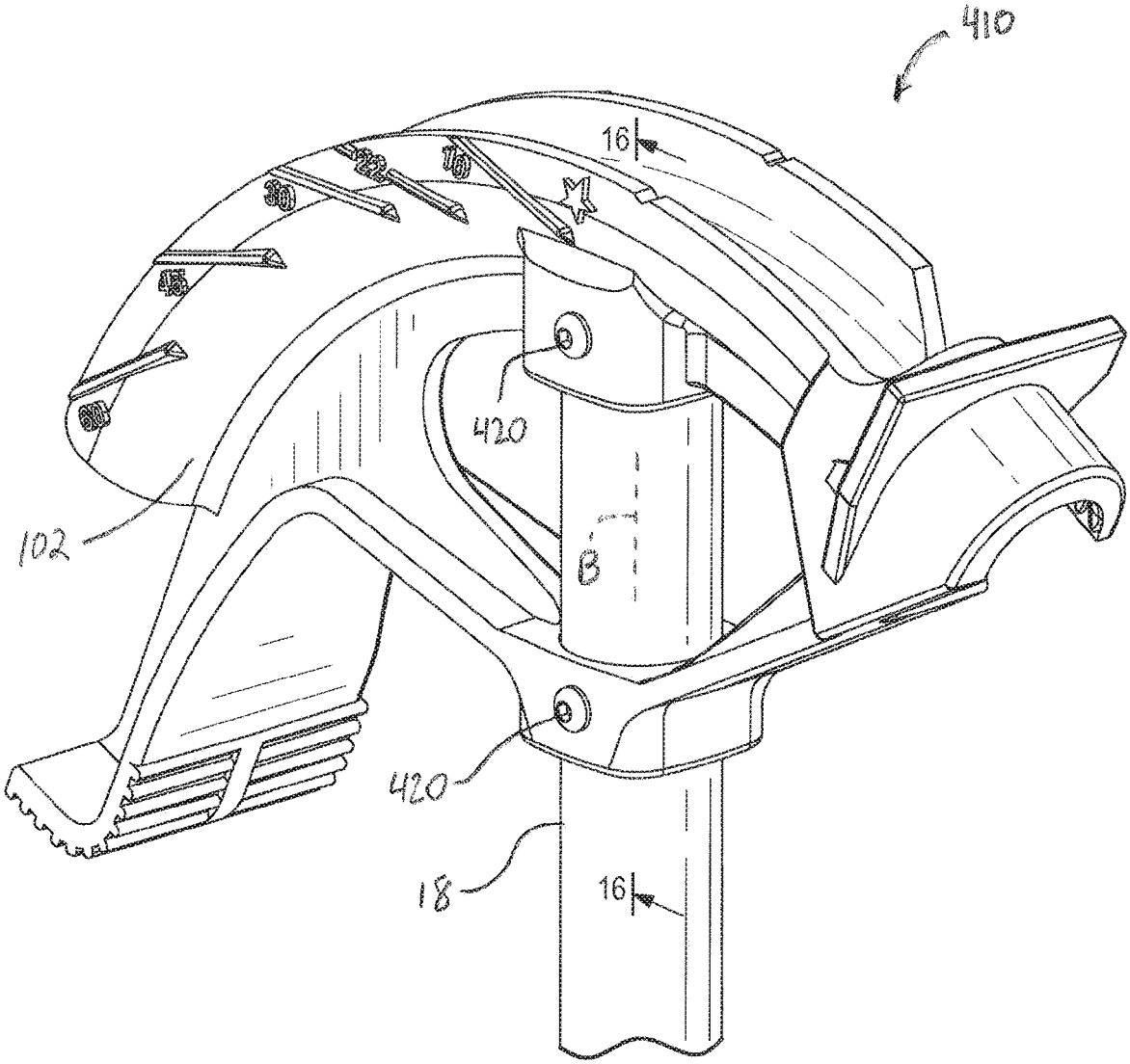
FIG. 15 is a perspective view of a conduit bender according to an embodiment of the invention.
Figure 16:
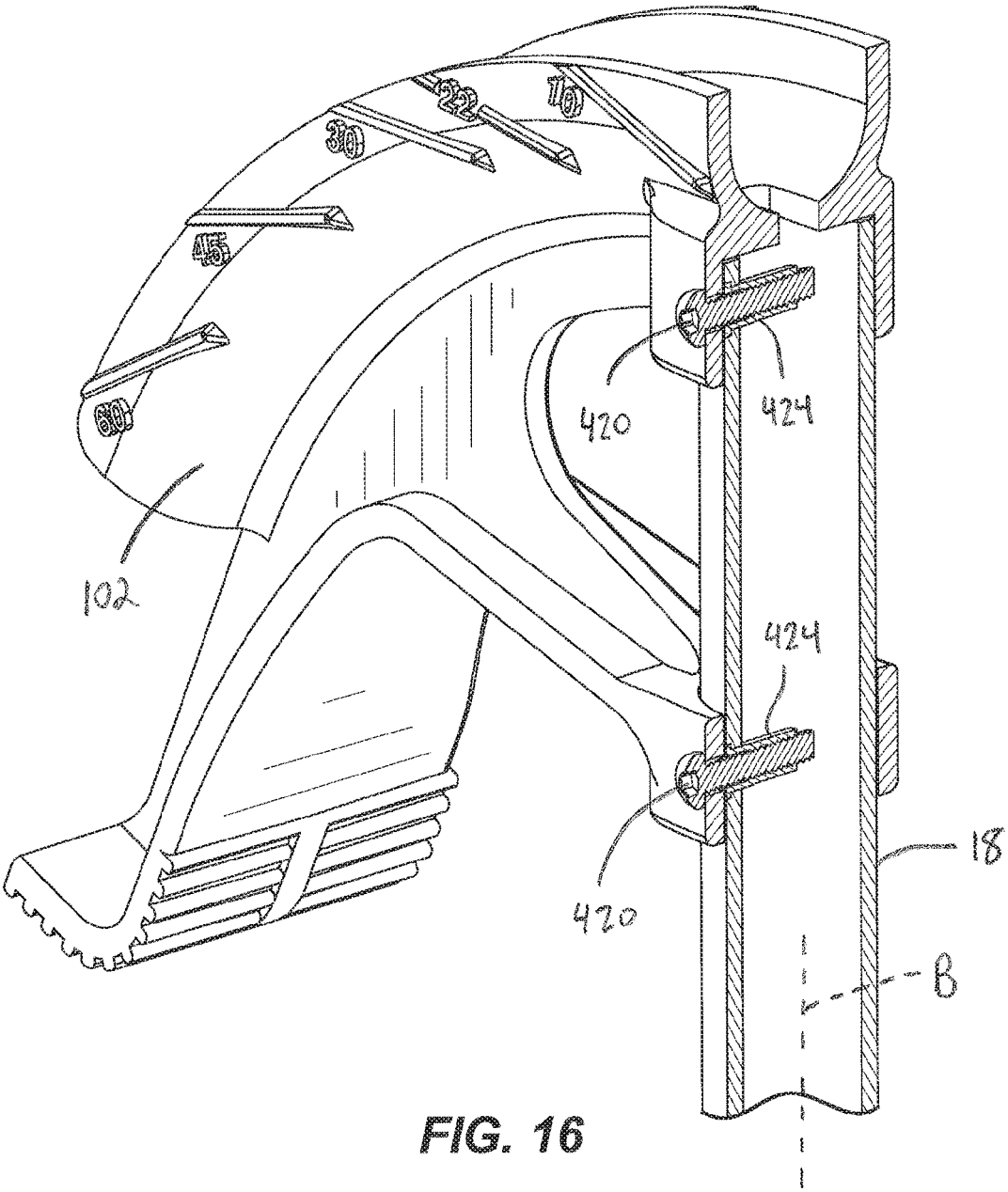
FIG. 16 is a cross-sectional view of the conduit bender of FIG. 15, taken along line 16-16 in FIG. 15.

FIGS. 15-16 illustrate a portion of a conduit bender 410 according to another embodiment. The conduit bender 410 is similar to the conduit bender 10 described above with reference to FIGS. 1-14, except that the second shaft portion 18 is coupled to the shoe 102 by a plurality of fasteners 420. The illustrated fasteners 420 are threaded bolts that are inserted through the shoe 102 and the second shaft portion 18 in a direction transverse to the longitudinal axis B. The fasteners 420 may be positioned on the same side of the shoe 102, as illustrated in FIGS. 15 and 16, or the fasteners 420 may be positioned on opposite sides of the shoe 102. Threaded bosses 424 are provided in the second shaft portion 18 to receive the fasteners 420 (FIG. 16). The threaded bosses 424 are preferably internally-threaded rivet nuts (e.g., RIVNUTS) that are secured within holes in the second shaft portion 18 by riveting. Alternatively, the threaded bosses 424 may be press-fit or welded in place within holes in the second shaft portion 18. In yet other embodiments, the threaded bosses 424 may be an integral part of the second shaft portion 18 formed, for example, using a flow drilling process followed by a tapping process.

Figure 17:
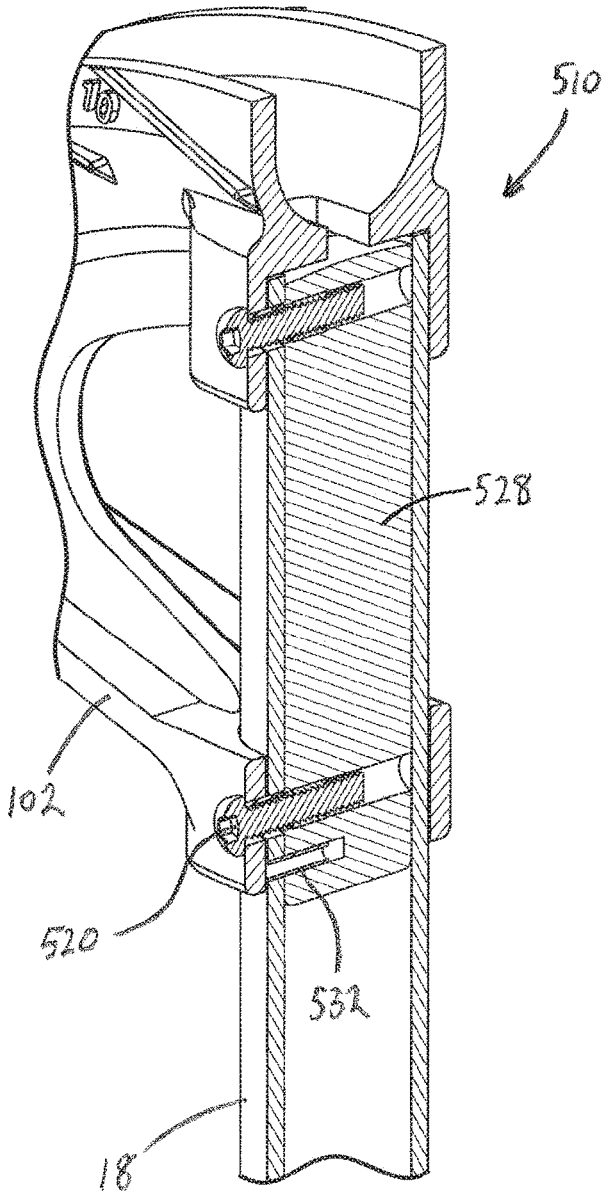
FIG. 17 is a cross-sectional view of a conduit bender according to another embodiment.

FIG. 17 illustrates a portion of a conduit bender 510 according to another embodiment. The conduit bender 510 is similar to the conduit bender 410 described above with reference to FIGS. 15-16, except that the threaded bosses 424 are omitted. Instead, a plug 528 is provided within the second shaft portion 18, and fasteners 520 are threaded into the plug 528. The plug 528 may be secured within the second shaft portion 18 by pressing the plug 528 into the second shaft portion 18. In the illustrated embodiment, the plug 528 is at least partially secured in the second shaft portion 18 by a pin 532. The pin 532 prevents the plug 528 from rotating within the second shaft portion 18 (e.g., if the fasteners 520 are removed). In an alternative embodiment, the plug 528 may extend from the shoe 102, and the second shaft portion 18 may be slid over the plug 528 during assembly. The pin 532 may then be inserted to secure the plug 528 in its final position.

Figure 18:
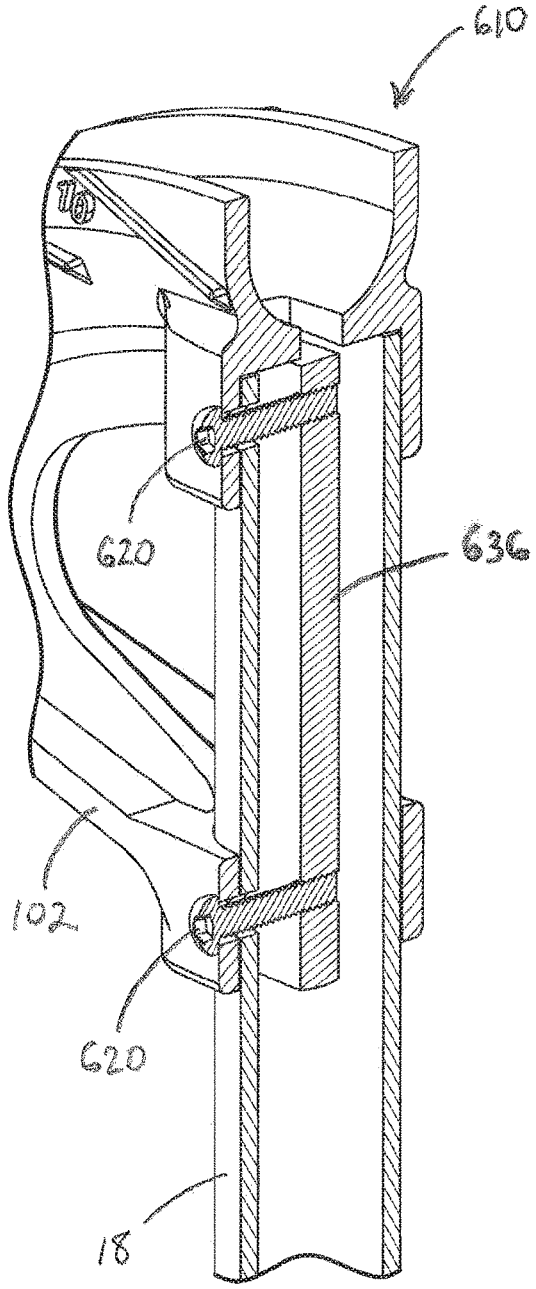
FIG. 18 is a cross-sectional view of a conduit bender according to another embodiment.

FIG. 18 illustrates a portion of a conduit bender 610 according to another embodiment. The conduit bender 610 is similar to the conduit bender 510 described above with reference to FIG. 17, except that the plug 528 is replaced by a bar 636 that extends though the center of the second shaft portion 18. Fasteners 620 are threaded directly into the bar 636. The bar 636 is thinner than the plug 528 such that the overall weight of the conduit bender 610 may be reduced. The bar 636 may be secured within the second shaft portion 18 via a press fit, a pin (e.g., the pin 532 described above), welding, or in a variety of other ways. Alternatively, the bar 636 may extend from the shoe 102, and the second shaft portion 18 may be slid over the bar 636 during assembly.

Figure 19:
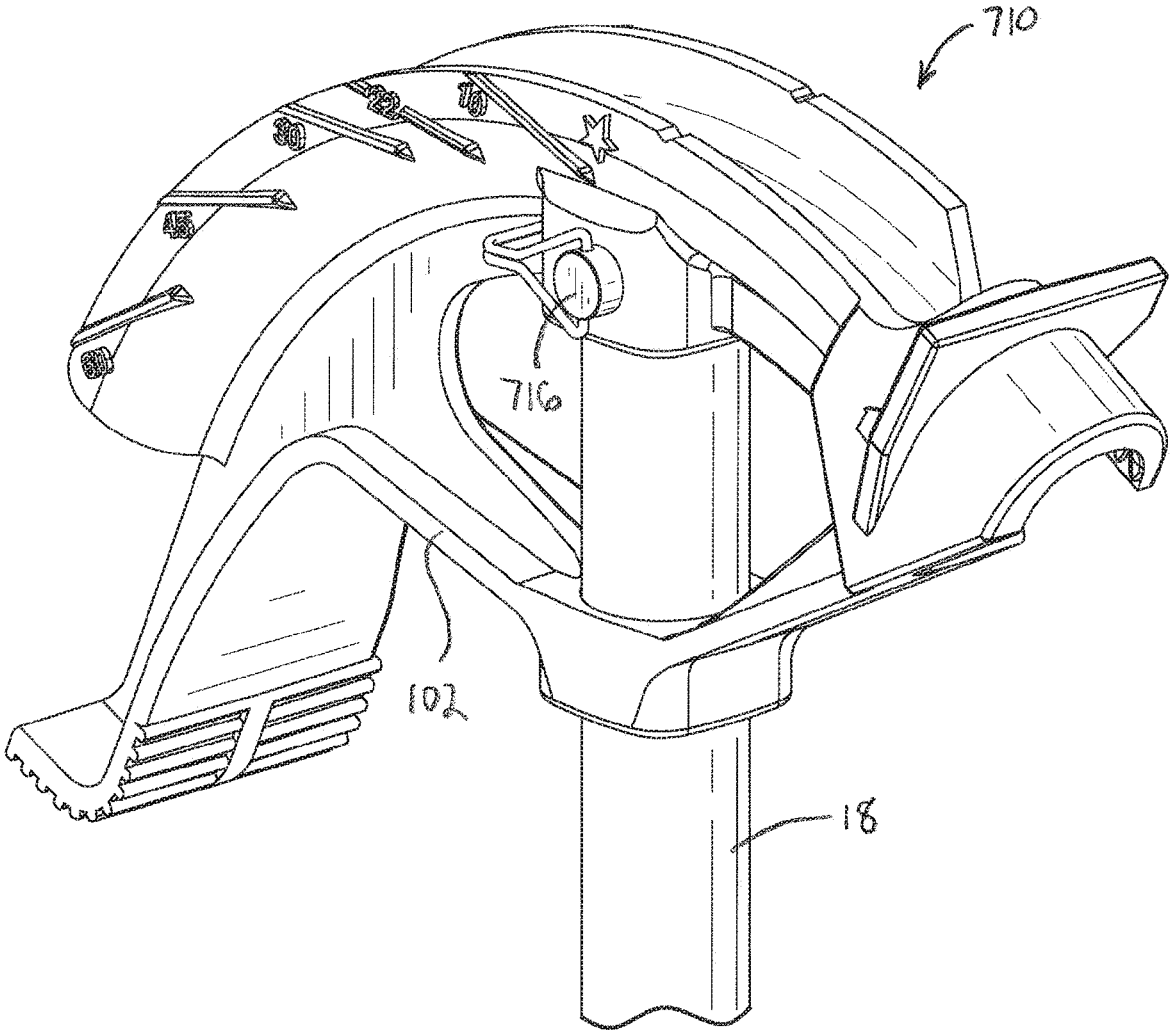
FIG. 19 is a perspective view of a conduit bender according to another embodiment.

FIG. 19 illustrates a portion of a conduit bender 710 according to another embodiment. The conduit bender 710 is similar to the conduit bender 10 described above with reference to FIGS. 1-14, except that the second shaft portion 18 is coupled to the shoe 102 by a single cotter pin 716. This advantageously permits convenient tool-free removal of the second shaft portion 18 from the shoe 102.

Figure 20:
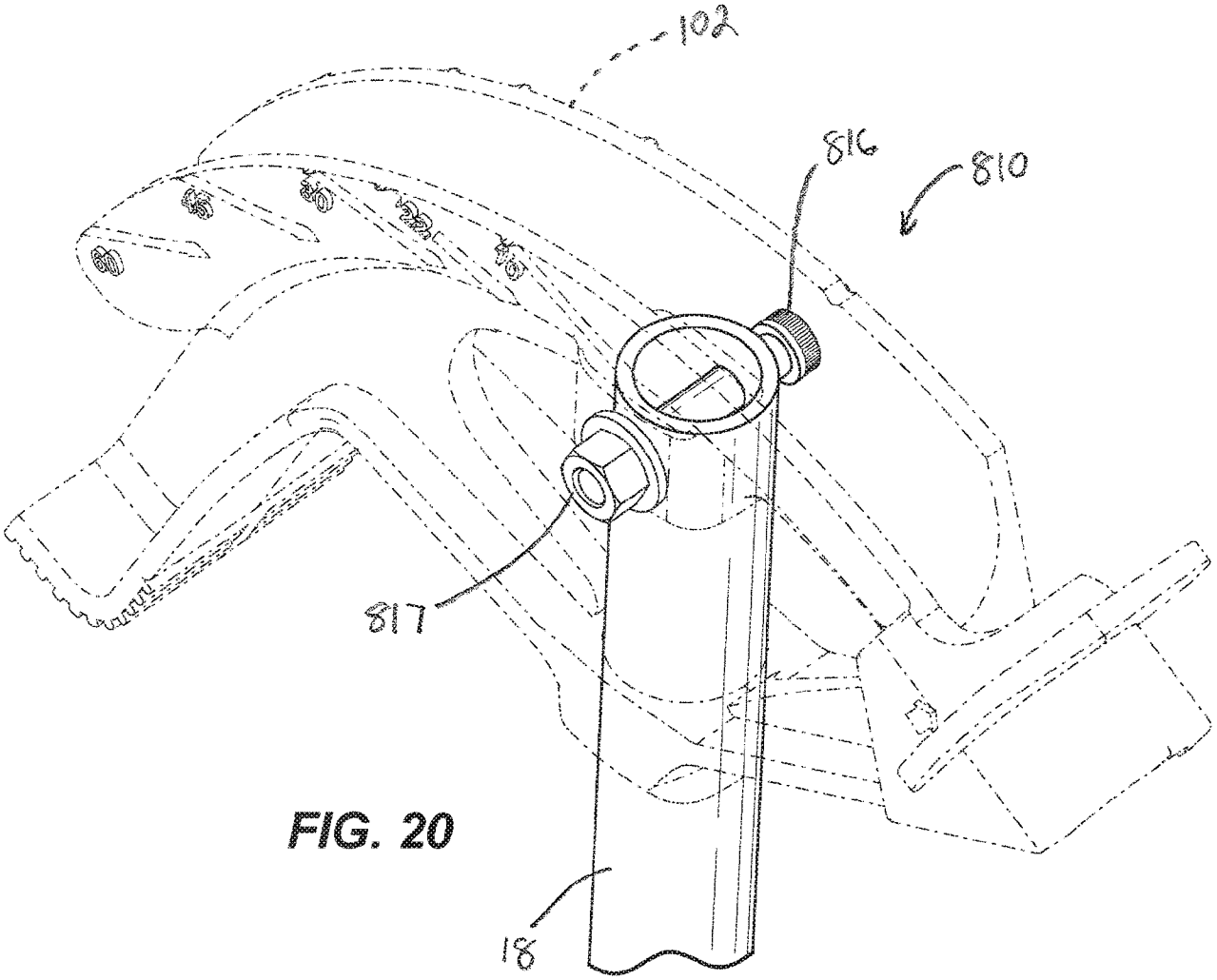
FIG. 20 is a perspective view of a conduit bender according to another embodiment.

FIG. 20 illustrates a portion of a conduit bender 810 according to another embodiment. The conduit bender 810 is similar to the conduit bender 710 described above with reference to FIG. 19, except that the cotter pin 716 is replaced by a threaded fastener 816 (e.g., a cap screw) and a nut 817.

Various features of the invention are set forth in the following claims.

What is claimed is:

1. A tool for bending an elongated workpiece, the tool comprising:

a shaft having a first shaft portion and a second shaft portion;

a coupling assembly coupling the first shaft portion and the second shaft portion, the coupling assembly having a locked configuration in which the coupling assembly inhibits movement of the first shaft portion relative to the second shaft portion, and an unlocked configuration in which the coupling assembly permits movement of the first shaft portion relative to the second shaft portion;

a shoe coupled to the second shaft portion, the shoe including a curved bottom portion and a hook configured to hold the workpiece against the curved bottom portion, wherein the curved bottom portion is engageable with the workpiece to bend the workpiece;

a threaded boss coupled to and extending into the second shaft portion; and a threaded fastener extending through a portion of the shoe and engaging the threaded boss to couple the shoe to the second shaft portion;

wherein the second shaft portion includes a hole formed in a sidewall of the second shaft portion and the threaded boss is coupled to and extends through the hole and through the sidewall and into a hollow central area within the second shaft portion.

2. The tool of claim 1, wherein the first shaft portion defines a first longitudinal axis, wherein the second shaft portion defines a second longitudinal axis, and wherein an angle between the first longitudinal axis and the second longitudinal axis is adjustable when the coupling assembly is in the unlocked configuration.

3. The tool of claim 2, wherein the coupling assembly defines a pivot axis transverse to the first longitudinal axis and the second longitudinal axis, and wherein the first shaft portion is pivotable relative to the second shaft portion about the pivot axis when the coupling assembly is in the unlocked configuration.

4. The tool of claim 1, wherein the first shaft portion is longer than the second shaft portion.

5. The tool of claim 1, wherein the coupling assembly includes a first toothed member coupled to the first shaft portion and a second toothed member coupled to the second shaft portion, wherein the first toothed member is engaged with the second toothed member when the coupling assembly is in the locked configuration, and wherein the first toothed member is disengaged from the second toothed member when the coupling assembly is in the unlocked configuration.

6. The tool of claim 5, wherein the first shaft portion defines a first longitudinal axis, wherein the second shaft portion defines a second longitudinal axis, wherein the coupling assembly defines a pivot axis transverse to the first longitudinal axis and the second longitudinal axis, and wherein the first shaft portion is pivotable relative to the second shaft portion about the pivot axis when the coupling assembly is in the unlocked configuration.

7. The tool of claim 6, wherein the first toothed member is movable relative to the second toothed member along the pivot axis to disengage the first toothed member from the second toothed member.

8. The tool of claim 6, wherein the first toothed member is movable relative to the second toothed member along the first longitudinal axis to disengage the first toothed member from the second toothed member.

9. The tool of claim 5, further comprising an actuator located on the first shaft portion, wherein the actuator is movable to disengage the first toothed member from the second toothed member.

10. The tool of claim 9, further comprising an over-center linkage coupling the actuator and the first toothed member, the over-center linkage configured such that movement of the actuator in a first direction along the first longitudinal axis moves the first toothed member in a second direction opposite the first direction.

11. The tool of claim 1, wherein the threaded boss extends into the second shaft portion in a direction perpendicular to a longitudinal axis of the second shaft portion, wherein a length dimension of the threaded boss in the direction perpendicular to the longitudinal axis of the second shaft portion is greater than a thickness of the sidewall of the second shaft portion.

12. The tool of claim 1, wherein the threaded boss comprises:

a flange located on an outer surface of the sidewall of the second shaft portion, the flange surrounding the hole through the sidewall; and a body defining a threaded central bore coupled to the flange.

13. The tool of claim 1, wherein the shoe further includes a top portion, the top portion extending from a first end of the curved bottom portion adjacent to the hook to a second end of the curved bottom portion, wherein the top portion is configured to receive the second shaft portion.

14. The tool of claim 13, wherein the threaded fastener extends through the top portion of the shoe to couple the shoe to the second shaft portion.

15. A tool for bending an elongated workpiece, the tool comprising:

a shaft having a first shaft portion defining a first longitudinal axis and a second shaft portion including a sidewall and hollow central area and defining a second longitudinal axis;

a coupling assembly coupling the first shaft portion and the second shaft portion, the coupling assembly operable to selectively permit the first shaft portion to pivot relative to the second shaft portion about a pivot axis oriented transverse to the first longitudinal axis and the second longitudinal axis; and a shoe coupled to the second shaft portion, the shoe including a curved bottom portion and a hook configured to hold the workpiece against the curved bottom portion, wherein the curved bottom portion is engageable with the workpiece to bend the workpiece;

a first boss coupled to and extending through the sidewall into the hollow central area of the second shaft portion at a first location; and a first fastener extending through a first portion of the shoe and engaging the first boss;

a second boss coupled to and extending through the sidewall into the hollow central area of the second shaft portion at a second location spaced from the first location along the second longitudinal axis; and a second fastener extending through a second portion of the shoe and engaging the second boss;

wherein the engagement between the first fastener and the first boss and between the second fastener and the second boss couple the shoe to the second shaft portion.

16. The tool of claim 15, wherein the first and second bosses are threaded and the first and second fasteners are threaded.

17. The tool of claim 15, wherein the coupling assembly includes a first toothed member coupled to the first shaft portion and a second toothed member coupled to the second shaft portion, wherein the first toothed member is engageable with the second toothed member to selectively inhibit the first shaft portion from pivoting relative to the second shaft portion about the pivot axis, and wherein the first toothed member is disengageable from the second toothed member to selectively permit the first shaft portion to pivot relative to the second shaft portion about the pivot axis.

18. The tool of claim 17, wherein the first toothed member is movable relative to the second toothed member along the pivot axis to disengage the first toothed member from the second toothed member.

19. The tool of claim 17, wherein the first toothed member is movable relative to the second toothed member along the first longitudinal axis to disengage the first toothed member from the second toothed member.

20. The tool of claim 17, further comprising an actuator located on the first shaft portion, wherein the actuator is movable from an initial position to an actuated position to disengage the first toothed member from the second toothed member.

21. The tool of claim 20, further comprising an over-center linkage coupling the actuator and the first toothed member, wherein the over-center linkage inhibits disengagement of the first toothed member from the second toothed member when the actuator is in the initial position.

22. The tool of claim 15, wherein the coupling assembly is operable to permit the first shaft portion to pivot relative to the second shaft portion about the pivot axis in a first direction, and wherein the coupling assembly is operable to inhibit the first shaft portion from pivoting relative to the second shaft portion about the pivot axis in a second direction opposite the first direction.

* * * * *